United States Patent [19]

Hurban

[11] 4,379,254

[45] Apr. 5, 1983

[54] DIMMER CIRCUIT FOR FLUORESCENT LAMP

[75] Inventor: Frederick L. Hurban, Vineland, N.J.

[73] Assignee: Andrew L. D'Orio, Vineland, N.J.

[21] Appl. No.: 246,524

[22] Filed: Mar. 23, 1981

[51] Int. Cl.[3] ..... H05B 41/392

[52] U.S. Cl. ..... 315/291; 315/199; 315/307; 315/DIG. 4; 323/243

[58] Field of Search ..... 315/194, 199, 208, 291, 315/307, 311, DIG. 4; 323/242, 243, 325, 326

[56] References Cited

U.S. PATENT DOCUMENTS

| | | | |
|---|---|---|---|
| 3,793,557 | 2/1974 | Cramer | 315/199 |
| 3,863,102 | 1/1975 | Herzog | 315/DIG. 4 |
| 3,873,910 | 3/1975 | Willis, Jr. | 323/6 |
| 3,875,458 | 4/1975 | Kappenhagen | 315/291 X |
| 3,890,562 | 6/1975 | West | 323/14 |
| 4,037,148 | 7/1977 | Owens et al. | 323/17 |
| 4,039,897 | 8/1977 | Dragoset | 315/205 |
| 4,052,648 | 10/1977 | Nola | 318/810 |

*Primary Examiner*—Eugene R. LaRoche
*Attorney, Agent, or Firm*—Seidel, Gonda, Goldhammer & Panitch

[57] ABSTRACT

An intensity control for fluorescent lamps of the type wherein a triac in series with the lamp provides control of the lamp current. Triac gating is controlled by a novel phase-lock circuit. In the phase-lock circuit, voltage squaring means are provided for producing unipolar square waves having a pulse width equal to a corresponding half cycle of the a.c. input power. Ramp waves generated from the square waves are applied to the base of a PNP transistor. Current through the lamp is sampled and produces a proportional voltage signal which is superimposed on a parallel path of the square waves to create a phase reference signal. An intensity control potentiometer supplies a selectable d.c. intensity control signal of polarity opposite the phase reference signal, and the intensity control signal and phase reference signal are algebraically added together. The resultant signals apply to the inverting input of integrating amplifier which reverses the polarity and integrates the resultant signal. The integrated signal is also connected to the base of the PNP transistor. The PNP transistor conducts when the combined voltage of the ramp signals and integrated signals fall below zero potential. When the transistor conducts, a circuit is completed supplying a control signal to the gate of the triac.

3 Claims, 2 Drawing Figures

10
12
14
16
A.C. HOT
18
LIGHTING LOAD
20
TRIAC
22
LOAD SENSOR
24
A.C. NEUTRAL
25
REGULATED POWER SUPPLY
26
VOLTAGE SQUARING AMP
28
VOLTAGE RAMP GENERATOR
RAMP/VOLTAGE
30
LOAD REFF. AMP
32
+ VOLTAGE
- ALL CIRCUITS
34
INTENSITY CONTROL
36
38
40
SUMMING AMP/ LOW PASS FILTER
START-UP DELAY
PULSE
42
GATE CONTROL

DIMMER CIRCUIT FOR FLUORESCENT LAMP

BACKGROUND OF THE INVENTION

This invention is related to the field of intensity controls, or dimmers, for fluorescent lamps. More particularly, it is related to intensity controls in which a triac regulates the current flow through the fluorescent lamp.

It is well known to use triacs or controlled rectifiers in dimmer circuits for fluorescent lamps. Fluorescent lamps cannot effectively be controlled by a simple variable resistance, as with incandescent lamps, because fluorescent lamps are closely matched with their associated ballast in order to maintain an effective power factor. Introducing a variable resistance into the circuit would provide low power factors at certain intensity settings, thereby diminishing the efficiency of the circuit.

Accordingly, it has become common practice in the art of controlling fluorescent lamps to use triacs as the main control element. A control circuit is provided to the triac in order to provide proper triac switching in phase with the input power signal. One of the more efficient types of a control circuit is a phase-locked loop. An example of such a circuit is disclosed in U.S. Pat. No. 4,039,897.

The present invention also uses a triac control with a phase-locked loop control circuit. The present control circuit is in many ways similar to the control circuit for use with a.c. induction motors disclosed in U.S. Pat. No. 4,052,648, and produced under license by the present inventor, and herein incorporated by reference.

SUMMARY OF THE INVENTION

An intensity control is provided for fluorescent lamps. The intensity control is of the type wherein a triac in series with the lamp provides control of the current through the lamp. Gating of the triac is controlled through a novel phase-locked circuit. In the phase-locked circuit, voltage squaring means are provided for producing unipolar square waves each having a pulse width approximately equal to a corresponding half cycle of the a.c. input power to the triac. Means are provided for generating ramp waves corresponding to the square waves, each of the ramp waves rising abruptly at the leading edge of its corresponding square wave and decaying linearly to reach zero potential at the trailing edge of the corresponding square wave. The ramp waves are applied to the base of a PNP transistor. Means are provided for producing a voltage signal proportional to the current through the lamp. This voltage signal is superimposed on the square waves to create a phase reference signal. An intensity control potentiometer supplies a selectable d.c. intensity control signal of polarity opposite the phase reference signal, and the intensity control signal and phase reference signal are algebraically added together. The resultant of the algebraic addition is applied to the inverting input of an integrating amplifier which reverses the polarity and integrates the resultant signal. The integrated signal output of the amplifier is connected to the base of the PNP transistor. The PNP transistor conducts whenever the combined voltage of the ramp signals and the integrated signal fall below zero potential. When the transistor conducts, a circuit is completed supplying a control signal to the gate of the triac.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
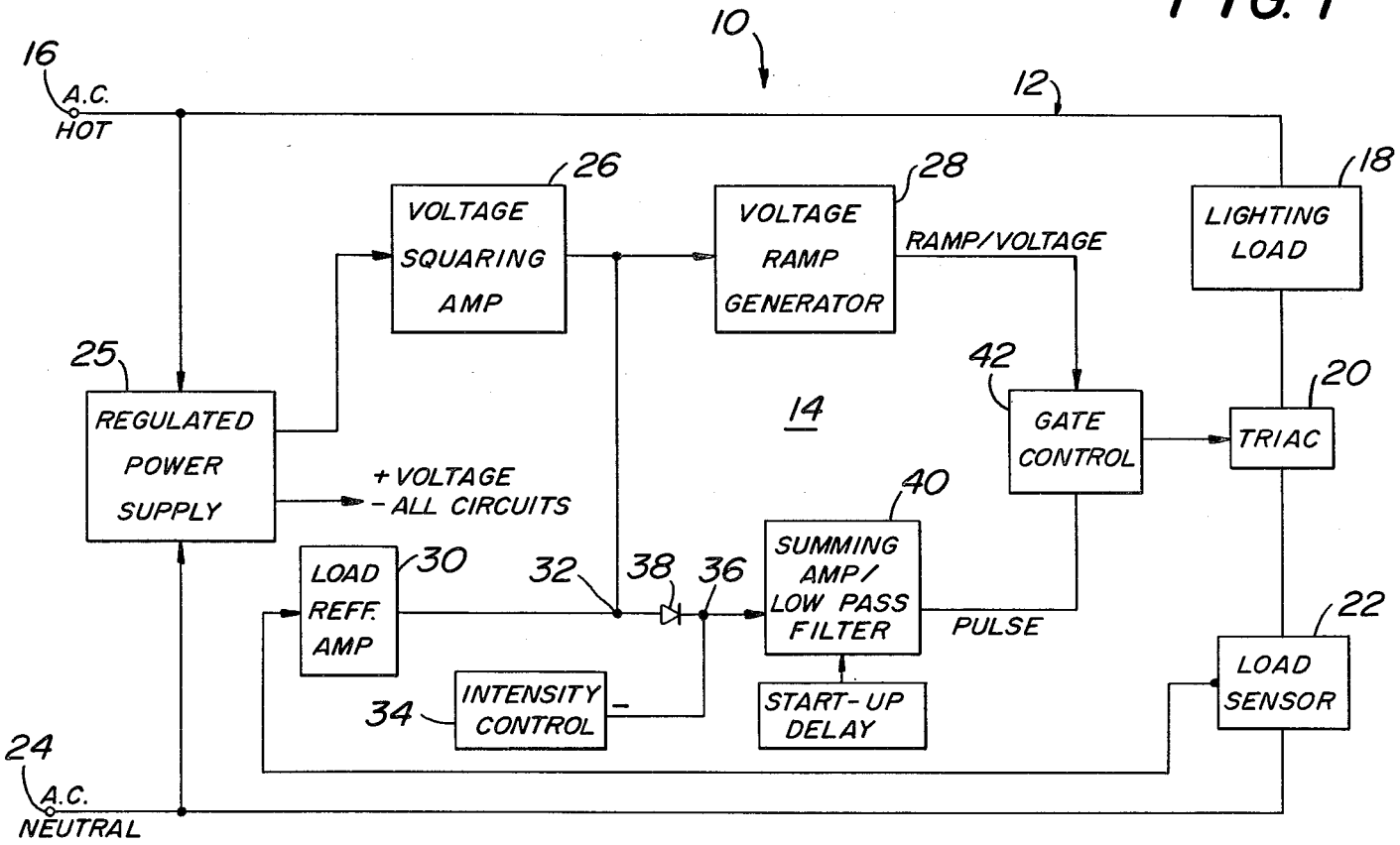
FIG. 1 is a block diagram of an intensity control circuit according to the present invention.

Referring now to the drawings wherein like numerals indicate like elements, FIG. 1 shows an intensity control circuit 10 according to the present invention. Circuit 10 comprises a power circuit 12 (outer loop in FIG. 1) and a control circuit 14 (inner loop). Starting from the a.c. input terminal 16, power loop 12 includes terminal 16, lamp load 18 (which includes both lamp and associated ballast), triac 20, load sensing resistor 22, and a.c. neutral terminal 24. Circuit 12 is typical of any fluorescent lamp circuit controlled by a triac. Triac 20, being in series with the lamp load 18, only allows current to pass during that portion of the duty cycle of the a.c. input when triac 20 is in a conducting state. By varying the point of the duty cycle in which triac 20 becomes conducting, the total current through lamp load 18 and the intensity of light from the fluorescent lamp can be controlled.

Thus, control of the dimmer circuit is entirely determined by control of the triac triggering. This control is accomplished by control loop 14. A regulated power supply 25 converts a.c. input power to low level d.c. voltages for use by the control elements in loop 14. A signal representative of the a.c. input signal is tapped at regulated power supply 25 and converted to positive and negative square waves by voltage squaring amplifier 26. The square wave output of amplifier 26 has the same frequency and wave length as the a.c. input signal. This squared signal is input to a voltage ramp generator 28, where it is converted to a ramp wave form. The ramp wave rises abruptly at the leading edge of the square wave and decays linearly to zero at the trailing edge of the square wave. The function of voltage squaring amplifier 26 and ramp generator 28 and the respective wave forms are disclosed in U.S. Pat. No. 4,052,648.

Load sensor 22 produces a voltage signal proportional to the current in power circuit 12 (current through the lamp). This voltage signal is input to load reference amplifier 30, which amplifies the signal and inverts the negative half wave. This amplified and inverted signal from amplifier 30 is summed at node 32 with the square wave output of amplifier 26. The square waves from amplifier 26 have the same wave length as the a.c. input signal, while the signal from amplifier 30 represents the current signal which is only present during a portion of each cycle of the a.c. input signal. Therefore, the signal from amplifier 30 is of shorter pulse width than the square waves from amplifier 26. Also, the reactance of lamp load 18 causes the signals from amplifier 30 and amplifier 26 to differ in phase by a nominal phase angle. Thus, the load reference signal from amplifier 30 is superimposed on the square waves 26, creating a phase reference signal.

An intensity control 34 produces a signal opposite in polarity to the composite signal at node 32. This opposite polarity signal from intensity control 34 is applied at node 36. Diode 38 is placed between nodes 32 and 36. The magnitude of intensity control signal 34 can be varied by the operator to effect dimming of the fluorescent lamp. At its highest setting (lamp brightest), the signal from intensity control 34 should be just greater than the signal from voltage squaring amplifier 26 and the forward bias of diode 38, so that the entire superimposed signal from load reference amplifier 30 will pass through diode 38. Lowering the settings on intensity control 34 produces a larger opposite polarity signal, and thus allows the signals from amplifier 30 to pass only at progressively higher amplitudes.

The signal passing through diode 38 is input to a summing amplifier/low pass filter 40. The low pass filter of element 40 is provided to block frequency components which might cause flickering of the lamp. The summing amplifier of element 40 integrates and reverses the polarity of the composite input signal received through diode 38, thus producing an opposite polarity d.c. signal proportional to the differences between the algebraic summation of the squared voltage signal from amplifier 26, the load reference signal from amplifier 30, and the signal from variable intensity control signal 34.

The output signal from element 40 is applied to gate control element 42. Also applied to gate control element 42 is the ramp voltage from generator 28. Gate control 42 adds the ramp voltage from generator 28 to the output from summing amplifier 40, and produces a control signal to triac 20 whenever the combined voltage falls below zero potential. The control singal gates triac 20 to a conducting state allowing current to pass through triac 20 until the immediately following zero crossing of the a.c. current signal in power circuit 12.

It will be apparent that for each setting of intensity control 34, there will be a particular point at which the ramp voltage from generator 28 plus the control signal from element 40 will go below zero potential. Changing the intensity control 34 changes the point at which the combined voltage falls below zero, thereby producing a phase locked switching control for triac 20.

Figure 2:
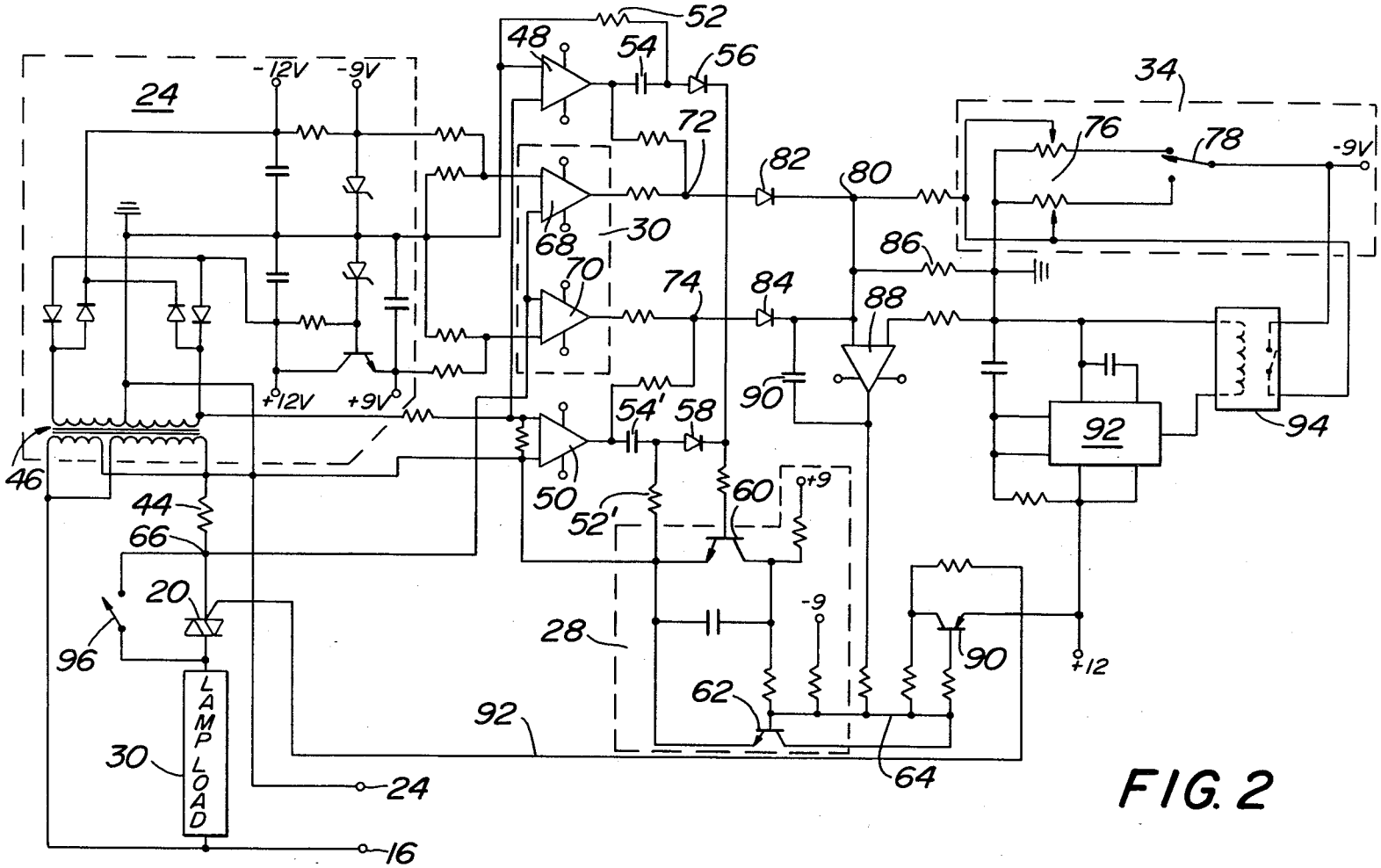
FIG. 2 is a schematic diagram of the intensity control circuit of FIG. 1.

Referring now to FIG. 2, greater details of control circuit 10 may be observed. Line input for a.c. power for the lamp circuit and control circuit is applied across terminals 16 and 24. Power circuit 12 includes terminal 16, lamp load 18, triac 20, resistor 44 (load sensor 22 of FIG. 1) and terminal 24. Terminal 24 is further connected to ground potential.

The regulated power supply 24 is a known circuit for converting an a.c. input into low level d.c. voltages. In the embodiment shown, there are four d.c. levels produced, ±12 volts and ±9 volts.

The a.c. input is coupled into power supply 24 by transformer 46, which also lowers the voltage. A signal is tapped from the low side of the secondary of transformer 46 and input to the voltage squaring amplifiers 48 and 50, which are operational amplifiers. The power line signals in the secondary of transformer 46 is input to the inverting input of amplifier 50 and to the non-inverting input of amplifier 48. The opposite inputs of amplifiers 48 and 50 are connected to electrical ground. The gains of amplifiers 48 and 50 are set in a known manner by the values of identical resistors 52, 52′ and identical capacitors 54, 54′ respectively to produce a constant amplitude square wave whenever the magnitude of the respective half cycles exceed ground potential. Thus, amplifier 48 puts out a positive square wave corresponding to positive half cycles of the input a.c. line voltage and amplifier 50 puts out a positive square wave corresponding to the negative polarity half cycles of the a.c. input. These square waves are combined unidirectionally through diodes 56 and 58, thus forming a rectified square wave input to the base of transistor 60.

Transistor 60 is part of ramp generators 28, a known circuit comprising identical transistors 60, 62, and associated resistors, capacitors and bias power supplies. Ramp generator 28 produces a ramp voltage on line 64, with each ramp having a duration corresponding to a half cycle of the a.c. line voltage. Each ramp rises abruptly with the leading edge of the corresponding square wave and decays linearly to reach zero at the trailing edge of the corresponding square wave.

A signal is tapped at node 66 which corresponds to the voltage across resistor 44 produced by the current through the lamp load. This reference signal is input to load reference amplifier 30, which comprises two operational amplifiers 68 and 70. The reference signal from node 66 is connected to the inverting input of amplifier 70 and to the non-inverting input of amplifier 68. The opposite inputs of amplifiers 68 and 70 are clamped to a low positive d.c. voltage. The output of amplifiers 68 and 70 is proportional to the difference between the signal from node 66 and the clamped voltage. Thus, amplifiers 68 and 70 provide amplification and half wave rectification (voltage doubling) for the signal from node 66.

The corresponding half cycle square wave from amplifier 48 is combined at node 72 with the amplified load current signal from amplifier 68. Similarly, the square wave signal from amplifier 50 is combined at node 74 with a signal from amplifier 70. Because of the smaller pulse width and difference in phase of the current signals to the a.c. input signals, as discussed previously, the signals from amplifiers 68 and 70 appear superimposed on square waves from amplifiers 48 and 50, respectively, creating a phase reference signal.

An intensity signal of negative polarity is produced by the intensity control circuit 34. Circuit 34 comprises a single adjustment dual potentiometer 76. A −9 volts is selectively connected to one or the other of the parallel branches of potentiometer 76 by switch 78. Operation of the intensity control 34 is the same no matter which branch is selected by switch 38; the dual branches simply providing increased reliability through redundance. The adjustment signal from intensity control 34 is applied at node 80. Diodes 82, 84 are between node 80 and node 72 and 74, respectively. Thus, a signal will only pass through diodes 82, 84 when the composite signals at nodes 72, 74 overcome the reverse bias provided by intensity control 34. Preferably, the highest setting (brightest lamp) setting of intensity control 34 is just sufficient to keep the square waves from causing diodes 82 and 84 to conduct. The superimposed current signal from amplifier 68 and 70 overcome the reverse bias and cause diodes 82 and 84 to conduct current through resistor 86 to ground.

The voltage signal representing the current through resistor 86 is input to the inverting input of amplifier 88. The other input of amplifier 88 is connected to ground. Amplifier 88, with the high frequency feedback provided by capacitor 90, reverses the polarity and integrates the input signal from node 80, and produces a level d.c. signal of opposite polarity proportional to the integrated value of the signal at node 80. This output signal is applied to bus 64. The ramp voltage produced by generator 28 is also being applied to bus 64. The base of PNP transistor 90 is connected to bus 64. The positive ramp signal maintains transistor 90 in an off state. When the negative integrated signal from amplifier 88 is applied to bus 64, it is summed with the ramp voltage and transistor 90 is switched on when the combined signal falls below zero potential. When transistor 90 is switched on (conducting), a trigger signal is applied along line 92 to the gate of triac 20, causing triac 20 to trigger into a conducting state.

It can be seen that by adjusting the potentiometer 76 of intensity control 34, the magnitude of the integrated signal from amplifier 88 can be adjusted, and thus determine the portion of the power line cycle when the triac triggers on, that is, the point at which the ramp waves summed on the integrated signal decay through zero potential.

A start up delay circuit is also provided. A one shot 92 is connected to the circuit in such manner that the initial application of line voltage supplies a reset signal followed by a trigger signal to monostable device 92. The output pin of monostable device 92 is connected to relay 94. Thus, when monostable device 92 is switched on, a current flows through the coil of relay 94, closing the relay switch. The closed relay switch connects the −9 volts of the intensity control element 34 to the −9 volt power supply without passing through potentiometer 76. This lowers the voltage at node 80, and allows the entire square wave to pass. Thus, the triac is gated on for the entire cycle of input current.

It should be noted that a bypass switch 96 is provided in order to cut triac 20 out of the circuit and provide for straight undimmed operation.

The present invention may be embodied in other specific forms without departing from the spirit or essential attributes thereof and, accordingly, reference should be made to the appended claims, rather than to the foregoing specification, as indicating the scope of the invention.

I claim:

1. In an intensity control for fluorescent lamps wherein a triac in series with the lamp provides control of the current through the lamp, a triac gating circuit comprising:

(a) square wave generating means for generat-unipolar square waves at twice the frequency of an a.c. power input to the triac, each square wave having a pulse width approximately equal to a half cycle of said a.c. power input;

(b) ramp wave generating means for generating a ramp voltage signal corresponding to each of said square waves, each ramp rising abruptly at the leading edge of the corresponding square wave and decaying linearly to reach zero potential at the trailing edge of said square wave, and said ramp waves being applied to the base of a PNP transistor;

(c) means for producing a voltage signal proportional to current through the lamp, said voltage signal being superimposed on said square waves;

(d) an intensity control potentiometer for producing a selectable intensity d.c. control signal of an opposite polarity to said square waves and superimposed voltage signal, said intensity control signal being at least equal to and opposite said square waves, and further being variable to higher than said square waves, whereby only all or a portion of said superimposed voltage signal passes to an input of an inverting and integrating operational amplifier;

(e) said amplifier generating a d.c. output proportional to the received signal and of opposite polarity, said output signal being applied to the base of said PNP transistor; and (f) said PNP transistor acting as a gating switch to selectively apply a control signal to the gate of the triac whenever the combined ramp signal and amplifier output signal at the base of the PNP transistor fall below zero potential.

2. Gating circuit as in claim 1, further comprising means for providing a temporary start up delay signal of selected duration which causes the PNP transistor to apply a continuous control signal to the triac.

3. Gating control as in claim 2 wherein the means for providing a start up delay signal includes a monostable device.

* * * * *